United States Patent [19]

Rotola, Jr. et al.

[11] Patent Number: 4,705,547

[45] Date of Patent: Nov. 10, 1987

[54] DIRT DRAWER LATCH FOR VACUUM CLEANER

[75] Inventors: Louis A. Rotola, Jr.; Gordon E. Laing, both of Anderson, S.C.

[73] Assignee: The Singer Company, Stamford, Conn.

[21] Appl. No.: 912,741

[22] Filed: Sep. 29, 1986

[51] Int. Cl.[4] ..... B01D 46/02

[52] U.S. Cl. ..... 55/374; 55/378; 55/471; 55/478; 15/327 E; 15/347

[58] Field of Search ..... 55/373, 374–378, 55/471, 478; 15/347, 327 E

[56] References Cited

U.S. PATENT DOCUMENTS

| | | | |
|---|---|---|---|
| 1,098,507 | 6/1914 | Krantz | 15/41 B |
| 2,409,078 | 10/1946 | Swann | 55/480 |
| 2,503,568 | 4/1950 | Timm | 55/300 |
| 2,564,339 | 8/1951 | Nerheim | 55/480 |
| 3,023,447 | 3/1962 | Senne | 55/378 |
| 4,586,214 | 5/1986 | Berfield | 15/327 E |

*Primary Examiner*—Bernard Nozick

*Attorney, Agent, or Firm*—David L. Davis

[57] ABSTRACT

A latch device for a filter bag supporting tray comprising a plurality of latch bolts operatively interrelated to move together so that blockage of any latch bolt will result in prevention of any other bolt from entering its latch recess, and only secure fully latched constraint of the tray is possible.

3 Claims, 5 Drawing Figures

DIRT DRAWER LATCH FOR VACUUM CLEANER

BACKGROUND OF THE INVENTION

1. Field of the Invention

This invention relates to vacuum cleaners having a dirt drawer or tray and, more particularly, to a novel and effective latch device for securing a vacuum cleaner dirt drawer in operative position.

2. Description of the Prior Art

Since a vacuum cleaner inherently finds use in an environment replete with foreign substances and debris, blockage and occasional malfunction of any closely interfitting latch device is likely. Most vacuum cleaner dirt drawers known in the prior art use only a single latch or drawer securing device such as disclosed in U.S. Pat. Nos. 1,098,507, June 2, 1914 of Krantz; 2,409,078, Oct. 8, 1946 of Swann; and 2,503,568, Apr. 11, 1950, of Timm. Those vacuum cleaners having dirt collecting compartments utilizing a plurality of latch or securing devices such as U.S. Pat. No. 1,156,236, Oct. 12, 1915, of Kirby, do not disclose any interrelationship between the latch devices.

OBJECTS OF THE INVENTION

It is an object of this invention to provide a dirt drawer latching arrangement which not only includes a plurality of latch devices to provide particularly secure retention of the dirt drawer in operative position, but which provides an interrelationship between the latch devices preventing movement of any of them into effective latching position if any of them meet with blockage or interference. In this way, only secure multiple latch engagement is possible and defective partial latching, which may not be detected by the operator of the vacuum cleaner, but which would be particularly prone to accidental dirt drawer release during cleaner operation, is obviated.

SUMMARY OF THE INVENTION

The latch of this invention is designed to constrain the front wall of a dirt drawer in substantially airtight position closing a dirt drawer accommodating opening in a vacuum cleaner body. The latch comprises a pair of latch bolts shiftably supported on the dirt drawer, each latch bolt being biased toward a position extending outwardly from the dirt drawer into engagement with a corresponding latch recess in the vacuum cleaner body. Each of the latch bolts is formed with an inclined cam slot engaging a common cam follower projection carried by a latch release element constrained on the drawer front. In the event that movement of either of the latch bolts into its respective latch recess is blocked, movement of the latch release element and of the other latch bolt into its latch recess will also be prevented. Thus, with the latch arrangement of this invention, either a secure latched condition is obtained with both latch bolts seated in their respective recesses, or the engagement of both latch bolts with their respective recesses is prevented, a condition which is readily detectable by an operator before use of the vacuum cleaner is initiated.

DESCRIPTION OF THE DRAWINGS

With the above and additional objects and advantages in view, as will hereinafter appear, this invention will now be described with reference to the accompanying drawings of a preferred embodiment in which.

Figure 1:
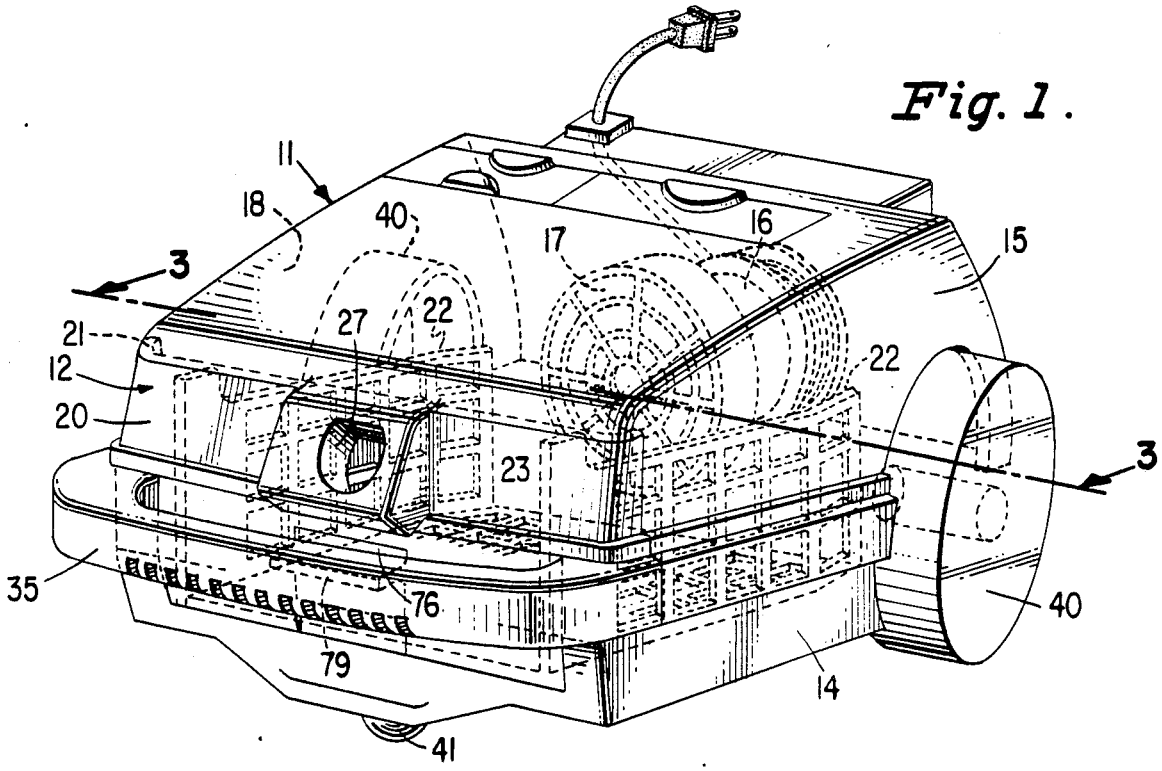
FIG. 1 is a perspective view of a vacuum cleaner having a disposable filter bag support tray inserted therein.
Figure 2:
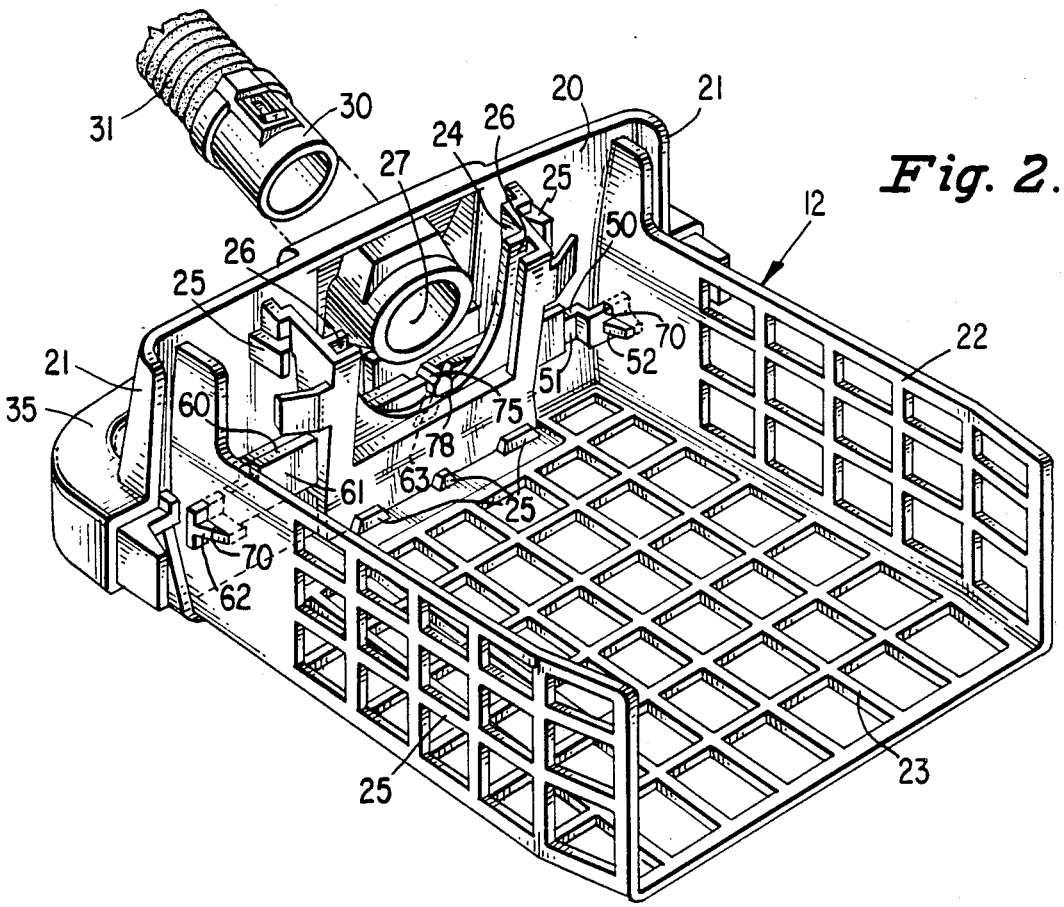
FIG. 2 is a perspective view of the filter bag support tray separated from the vacuum cleaner and shown with a fragment of the hose connector.

Illustrated in FIG. 1 is a canister type vacuum cleaner indicated generally at 11 including a filter bag supporting tray indicated generally at 12 inserted into an opening 13 formed in the vacuum cleaner. Preferably, the vacuum cleaner includes a body defined by a base portion 14 and a cover portion 15 together encasing a motor blower unit 16 having an inlet 17 opening into a compartment 18 within the vacuum cleaner body. The vacuum cleaner opening 13 provides access to the compartment 18 through which the tray 12 may be inserted. A front wall 20 of the tray 12 is arranged to close and tightly seal the opening 13 when the tray is fully inserted into the cleaner body. Peripheral extensions 21 from the front wall of the tray envelope the body portion of the cleaner around the opening 13 to improve the airtight nature of the closure formed by the front wall of the tray.

The tray 12 is formed with latticed side walls 22 and a bottom wall 23 extending from the front wall and on which a disposable filter bag (not shown) may rest. A bracket 24 is positioned and secured in place inside the tray front wall by a plurality of retaining lugs 25 on the tray. The bracket 24 is slotted as at 26 slidably to accommodate a stiff cardboard or plastic mounting plate which, as is conventional in the art, is secured adjacent the mouth of each disposable filter bag. The bracket 24 is positioned by the lugs 25 such that a valved opening in the filter bag mounting plate will be aligned with a hose connection port 27 formed through the front wall of the tray when the mounting plate of a disposable filter bag is fully inserted in the bracket slot 26 so that, when a connection extremity 30 on a flexible hose 31 leading to a cleaning tool (not shown) is inserted into the connection port 27, communication with the interior of a disposable filter bag will be established. The filter bag which may be of conventional construction is not included in the accompanying drawings so as not to obscure disclosure of the dirt drawer latch device of this invention.

Extending exteriorly across the front wall 20 of the tray is a handle 35 by which the tray may be manipulated into and out of the vacuum cleaner compartment 18 and by which the entire vacuum cleaner may be carried when the tray is secured in place within the vacuum cleaner body. Reliability of a means for latching the tray in place in the vacuum cleaner is important, therefore, not only to prevent spillage of collected dirt and debris should the tray accidentally become unlatched, but also to prevent injury to the cleaner or to the user of the cleaner should inadvertent unlatching occur during transport of the cleaner.

The cleaner body is provided with a pair of wheels 40 arranged beneath the motor blower unit 16 and a spherical roller 41 constrained beneath the compartment 18 on which the cleaner may be floor supported for ready movement in response to forces applied either by way of the flexible hose 31 or by way of the handle 35.

FIGS. 2, 3, 4 and 5 illustrate in various different ways the latch device of this invention by which an advantageously reliable retention of the tray 12 within the vacuum cleaner 11 is attained.

As illustrated, the latch device comprises a pair of latch bolts 50 and 60, each formed with a substantially flat planar body portion 51, 61, respectively, stacked against one another and transversely arranged against the inside surface of the front wall 20 of the tray. Each latch bolt at one extremity is formed with a projecting finger 52, 62, respectively, the outer edge of which is tapered outwardly toward the body portion as clearly shown in FIG. 2.

Each tray side wall 22 is formed adjacent the tray front wall 20 with a T-shaped aperture 70, and the latch bolts 50 and 60 are arranged with the projection fingers 52 and 62 extending in opposite lateral directions each constrained in one of the tray side wall T-shaped apertures 70. In addition to the constraint for the latch bolts 50 and 60 provided by the T-shaped apertures 70, the bracket 224, which serves the primary purpose of accommodating a disposable filter bag on the tray, is also formed with guide surfaces 71, 72 and 73 constraining the latch bolts 50 and 60 to sliding motion in a direction transversely across the tray front wall 20.

Each of the latch bolt body portions 51, 61, respectively, is formed with an upwardly open cam slot 53, 63, respectively, each of the cam slots 53, 63, being inclined in the opposite direction. The cam slots 53, 63 are both traversed by the operating projection 75 on a latch operating member 76 which projection also extends through and is guided by a vertical slot 77 formed through the front wall 20 of the tray 12. The free extremity of the operating projection 75 is formed with a downwardly extending lip 78 which overlaps the body portion 61 of the innermost latch bolt 60 thus to constrain the latch operating member 76 on the tray front wall. An operator influenced flange 79 on the latch operating member exteriorly of the tray is provided so that the user of the cleaner may at will depress the latch operating member and, by way of the inclined cam clots 53, 63, retract both latch bolt body portions inwardly within the T-shaped apertures 70 in the tray side walls.

For urging the latch bolts 50 and 60 outwardly to project laterally one beyond each of the tray side walls, the latch bolt body portions 51, 61 are formed each with a pair of elongate recesses 54, 64, for accommodating coil spring 55. Oppositely extending projections 56 and 66, one at each extremity of each of the elongate recesses 54, 64, respectively, each extend into the elongate recesses of the opposing latch bolt in the assembled relation of parts so as to constrain the coil springs 55, each spring between a set of projections 56, 66 from opposing latch bolts 50 and 60. As a result, when the latch bolts 50 and 60 are retracted as by operator depression of the latch operating member 76, the coil springs 55 will be compressed so that, upon relief of operator influence on the latch operating member 76, the force of the compressed springs 55 will urge the latch bolts outwardly.

Figure 3:
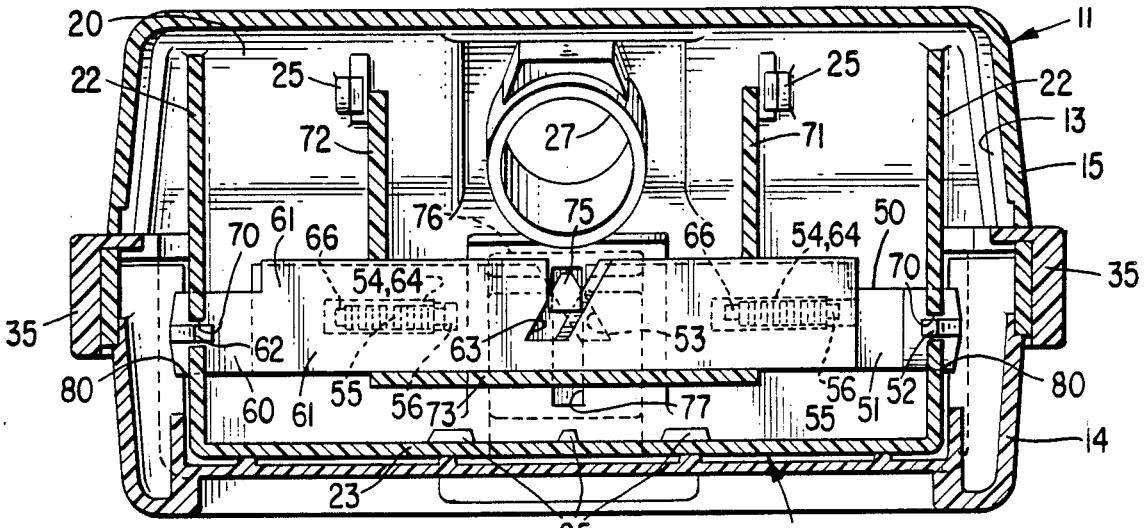
FIG. 3 is a cross sectional view taken substantially along line 3—3 of FIG.1 showing the bolts of the latch device of this invention fully extended and engaged, each with its respective latch recess in the vacuum cleaner body.
Figure 4:
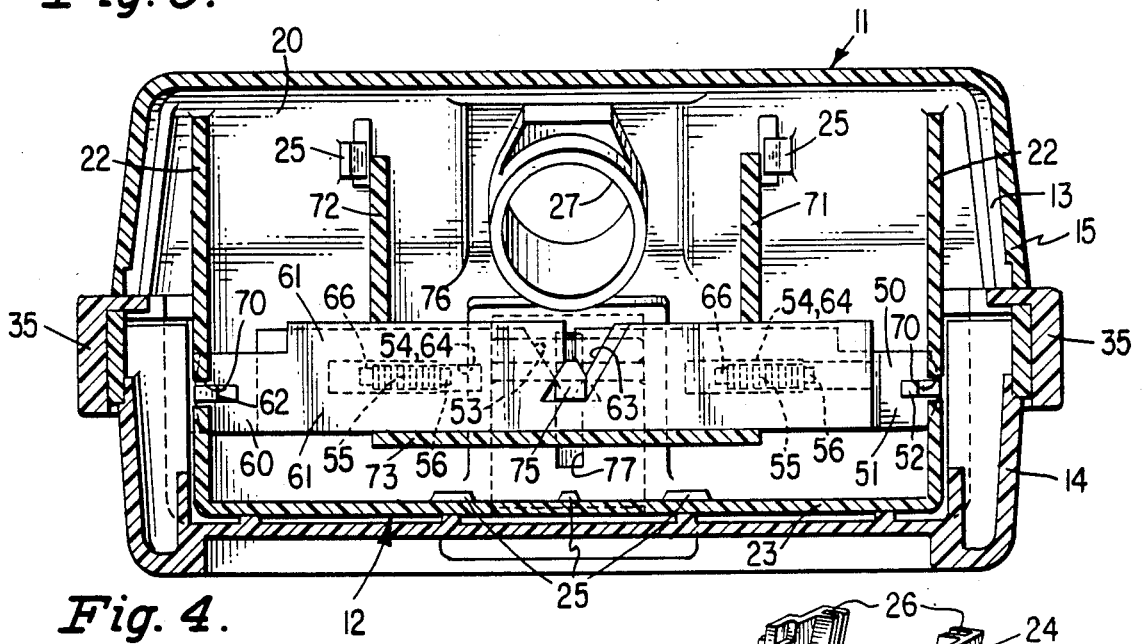
FIG. 4 is a cross sectional view similar to that of FIG. 3, but showing the bolts of the latch device each fully retracted.
Figure 5:
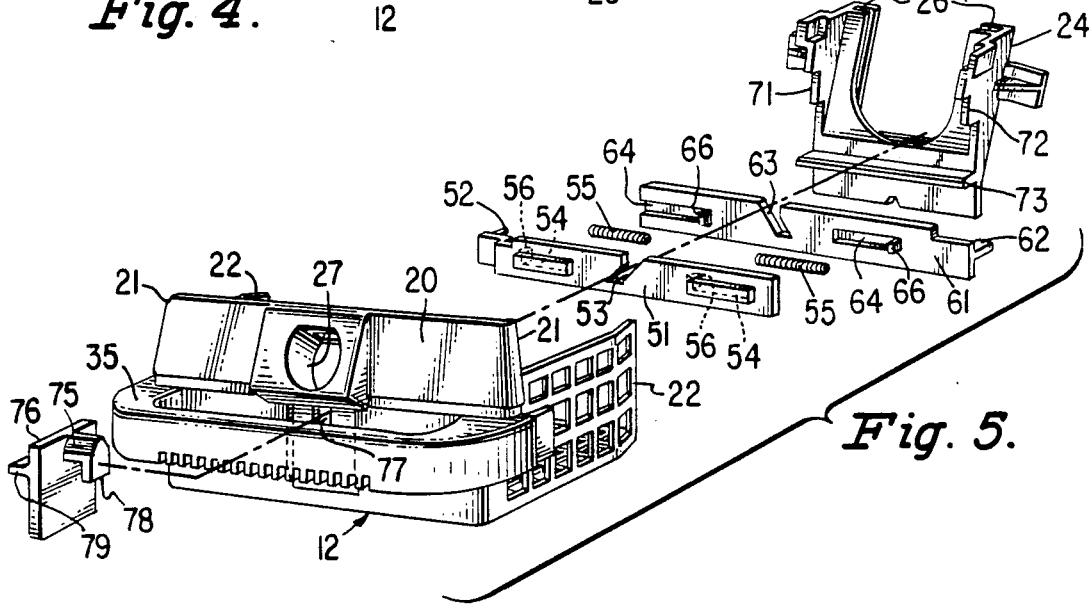
FIG. 5 is an exploded perspective view of the filter bag support tray, parts of the latch device of this invention, and the filter bag retaining bracket.

As shown in FIGS. 3 and 4, the body of the vacuum cleaner 11 preferably on the body base portion 14 within the compartment 18 is formed at each side with a latch accommodating recess 80. As the tray 12 is inserted through the opening 13 into the vacuum cleaner compartment 18, the tapered fingers 52, 62 of the latch bolts 50, 60 in engaging the body base portion 14 adjacent a recess 80 will be gradually forced inwardly in the same manner as when influenced by depression of the latch operating member 76 until the latch bolts 50 and 60 move inwardly opposite the latch recesses 80 whereupon the springs 55 will urge the latch bolts outwardly to occupy latched positions each extended into one of the latch recesses 80 thus securely retaining the tray 12 within the vacuum cleaner.

Since the latch bolts 50 and 60 are cooperatively interrelated by the projection 75 of the latch operating member 76 through both inclined cam slots 53, 63, should either one of the latch bolts become jammed or for any reason be prevented from shifting out the T-shaped slot 70, then the other of the latch bolts will similarly be restrained from moving outwardly and all latching of the tray will be prevented. Since such a condition, with no latch engagement at all, is readily discernable, it does not present any appreciable danger of accidental spillage of debris or of damage to the vacuum cleaner as would be the case if only one of the latch bolts engaged an abutment.

Accordingly there has been disclosed an improved latch for a vacuum cleaner dirt drawer. It is understood that the above-described embodiment is merely illustrative of the application of the principles of this invention. Numerous other arrangements may be devised by those skilled in the art without departing from the spirit and scope of this invention, as defined by the appended claims.

What is claimed is:

1. In a vacuum cleaner having a body formed with a tray accommodating opening; a motor blower unit associated with said housing for creating a vacuum therein; and a tray insertable into said housing through said tray accommodating opening; said tray including inlet means for supporting a disposable filter bag thereon, a front wall adapted to close said tray accommodating opening in said housing when said tray is inserted completely into said housing, and latch means for releasably restraining said tray completely inserted into said housing; the improvement comprising:

a plurality of latch bolts included in said latch means, each latch bolt shiftably supported on said tray;

said body being formed with a plurality of latch bolt accommodating recesses spaced from each other and arranged each in registry with a different one of said plurality of latch bolts when said tray is inserted completely within said body; and interlock means operationally interconnecting all of said latch bolts for shifting movement in unison between positions into and out of engagement with said respective registering recesses, whereby impedance of the shift of any one latch bolt into engagement with its respective registering recess will effect similar impedance of the shift of all of the other latch bolts.

2. The improvement as set forth in claim 1, in which said tray includes a front wall substantially coincident in size and shape with said tray accommodating opening in said body;

means defining a guide channel extending transversely across said front wall;

a pair of said latch bolts constrained in said guide channel and in which said interlock means comprises cam means shiftably supported on said front wall for movement in a path substantially perpendicular to the transverse extent of said guide channel; and each of said pair of latch bolts being formed with an oppositely inclined cam slot engaging said cam means.

3. The improvement as set forth in claim 2, in which spring means are provided acting between said latch bolts urging said latch bolts toward positions each extending outwardly beyond an opposite side of said front wall for engagement with a respective one of said body recesses.

* * * * *